US010856685B2

(12) United States Patent
Wolf et al.

(10) Patent No.: US 10,856,685 B2
(45) Date of Patent: Dec. 8, 2020

(54) AUTOMATIC ADJUSTMENT TUBE FOR CARPET STRETCHER TOOL

(71) Applicant: Crain Cutter Company, Inc., Milpitas, CA (US)

(72) Inventors: Barton S. Wolf, Brookfield, WI (US); Lance Darrell Crain, Pleasanton, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 513 days.

(21) Appl. No.: 15/623,313

(22) Filed: Jun. 14, 2017

(65) Prior Publication Data

US 2017/0354284 A1 Dec. 14, 2017

Related U.S. Application Data

(60) Provisional application No. 62/350,161, filed on Jun. 14, 2016.

(51) Int. Cl.
*A47G 27/04* (2006.01)

(52) U.S. Cl.
CPC ..... *A47G 27/0493* (2013.01)

(58) Field of Classification Search
CPC ..... A47G 27/0487; A47G 27/0493
See application file for complete search history.

(56) References Cited

U.S. PATENT DOCUMENTS 611,344 A * 9/1898 Wagner ..... A47G 27/0493 254/206
656,467 A * 8/1900 Miotke ..... D06F 59/02 223/61
1,534,759 A * 4/1925 Betterley ..... A47B 19/06 248/408
2,682,414 A * 6/1954 Richardson ..... B25B 15/02 279/77
2,883,222 A * 4/1959 Sands ..... F16B 5/06 403/363
3,094,787 A * 6/1963 Moore ..... G01B 3/08 33/809
3,693,936 A * 9/1972 Payson ..... A47G 27/0493 254/212
4,076,213 A * 2/1978 Payson ..... A47G 27/0493 254/210
4,230,302 A * 10/1980 Crain, Jr. ..... A47G 27/0493 254/212

(Continued)

*Primary Examiner* — Emmanuel M Marcelo
(74) *Attorney, Agent, or Firm* — Fenwick & West LLP

(57) ABSTRACT

A carpet stretcher device has an automatic adjusting tube that changes length with telescoping motion of an inside tube and an outside tube. A housing is mounted on the outside tube, and at least one lever is connected to the housing. A hand lever controls the motion of a spring-loaded rotating arm with a locking button positioned within the housing to insert and remove the locking button from holes in the tubes. When lifted away from the housing, the hand lever releases the rotating arms, which rotate to remove the locking button from holes in the tubes and thereby allow the tubes to telescope. The carpet stretcher may also have a floor lever that retracts when the device contacts a floor surface and extends when the device is lifted off a floor surface. When extended, the floor lever also releases the rotating arms, thereby allowing the tubes to telescope.

32 Claims, 10 Drawing Sheets

(56) References Cited

U.S. PATENT DOCUMENTS

| | | | | | |
|---|---|---|---|---|---|
| 4,577,837 | A * | 3/1986 | Berg | A47G 27/0493 | 248/408 |
| 4,934,658 | A * | 6/1990 | Berg | A47G 27/0493 | 248/408 |
| 5,183,238 | A * | 2/1993 | Sorensen | A47G 27/0493 | 254/200 |
| 5,221,064 | A * | 6/1993 | Hodges | F16L 3/133 | 248/333 |
| 5,281,045 | A * | 1/1994 | Ichikawa | F16B 7/105 | 403/108 |
| 5,605,411 | A * | 2/1997 | Wilson | A63B 21/0728 | 403/109.8 |
| 5,607,141 | A * | 3/1997 | Clark | A47G 27/0493 | 254/200 |
| 7,097,380 | B2 * | 8/2006 | Lee | F16B 7/105 | 15/80 |
| 8,469,425 | B1 * | 6/2013 | Lofley, Sr. | B25G 1/04 | 294/175 |

* cited by examiner

SECTION A-A

SECTION B-B

Figure 10
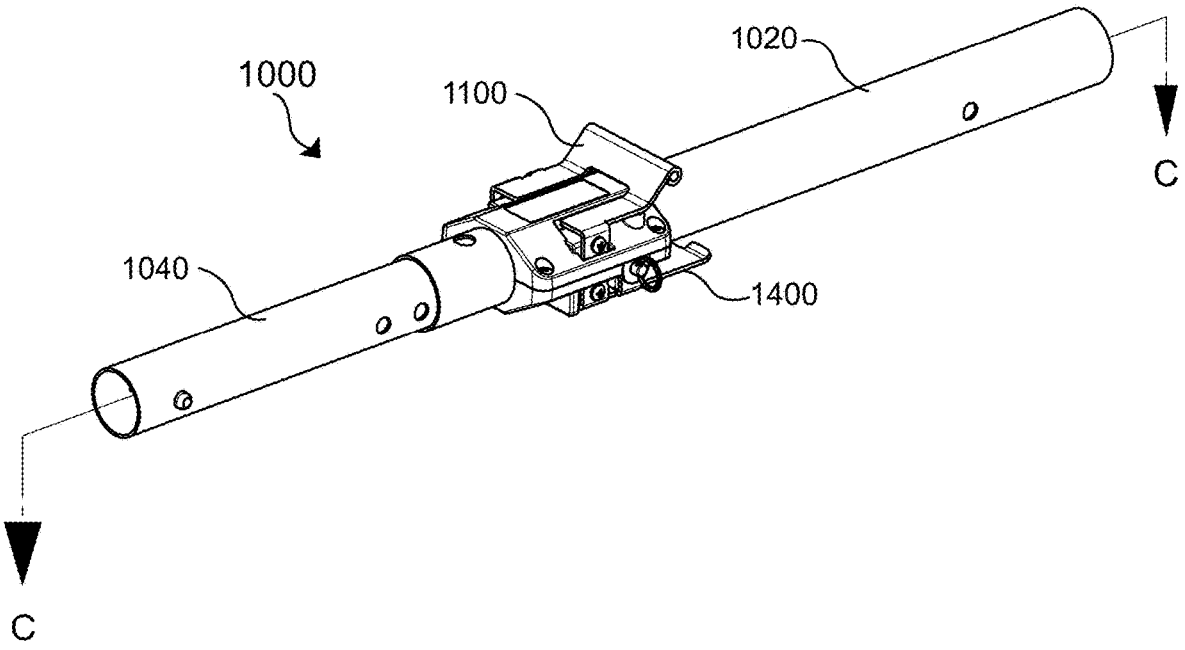
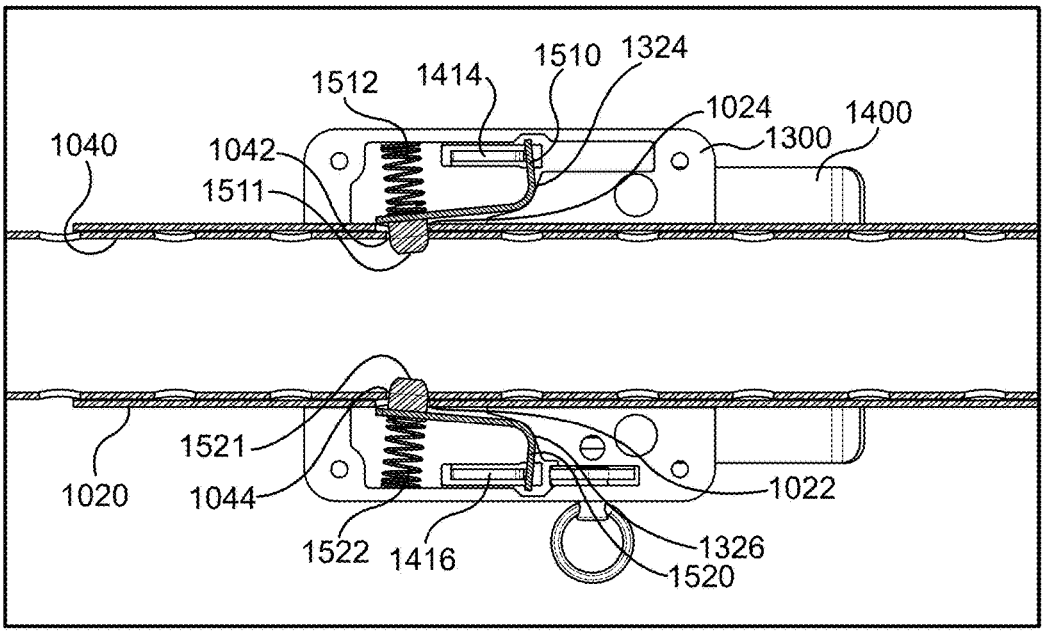
SECTION C-C
Figure 11

Figure 12
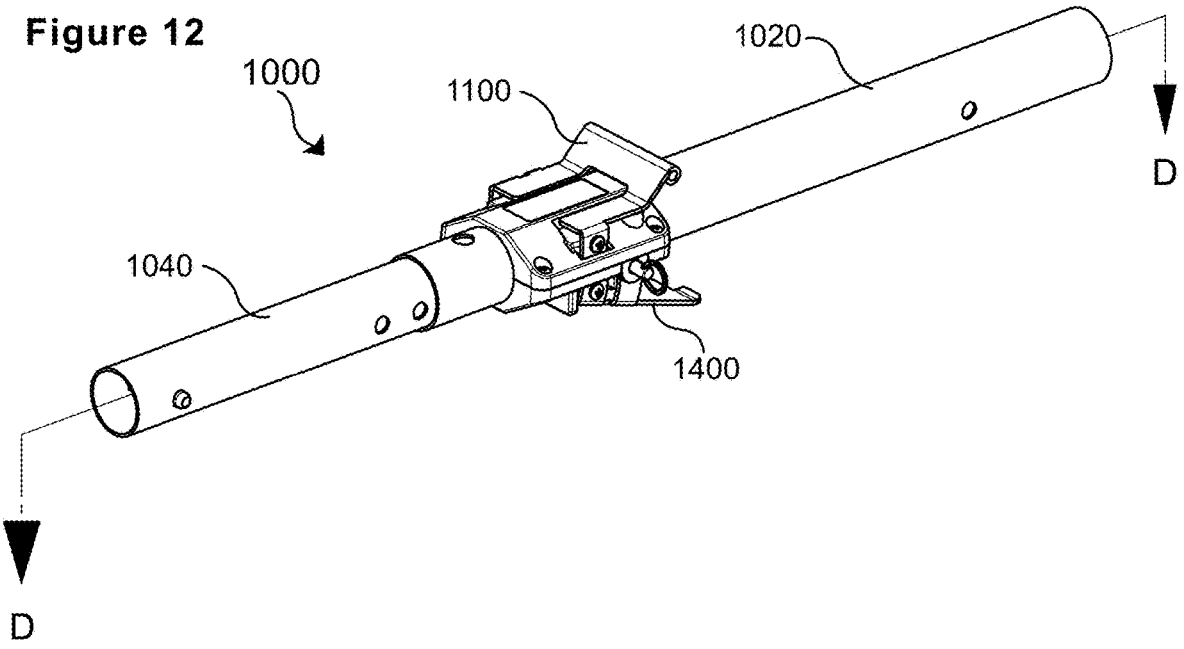
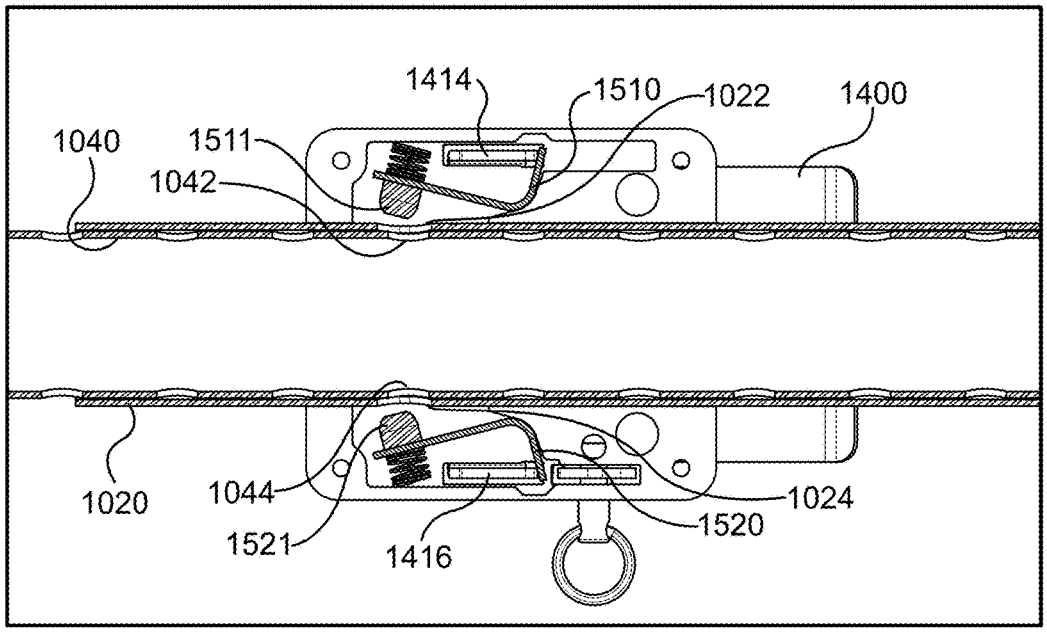
SECTION D-D
Figure 13

SECTION E-E

Figure 16
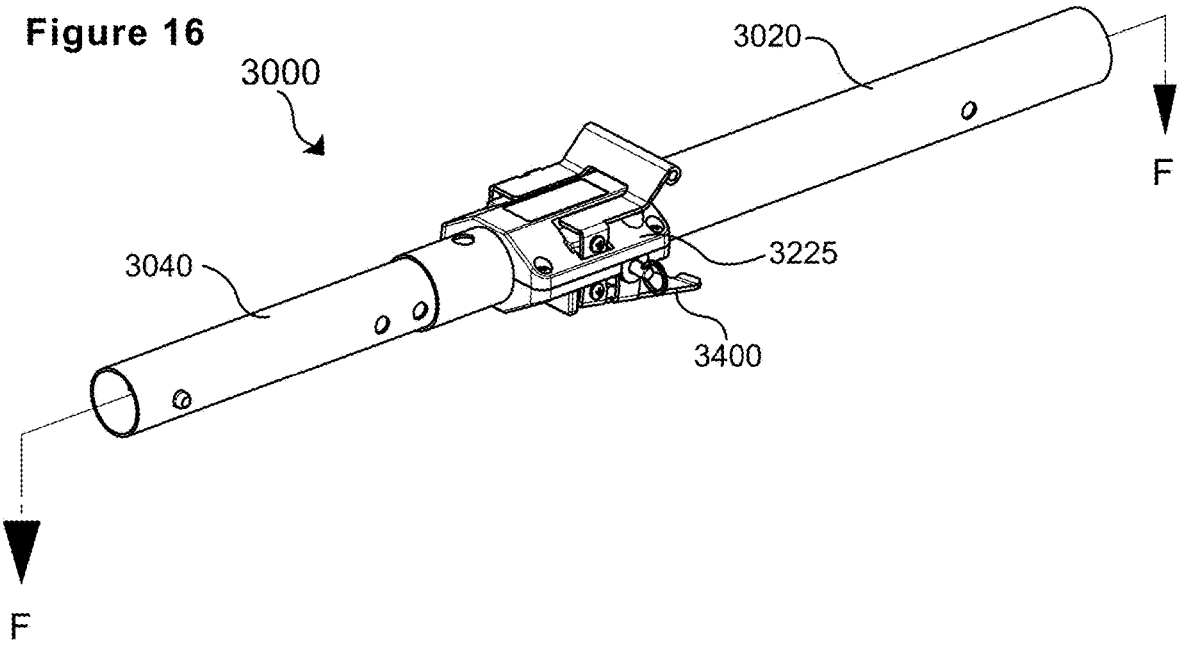
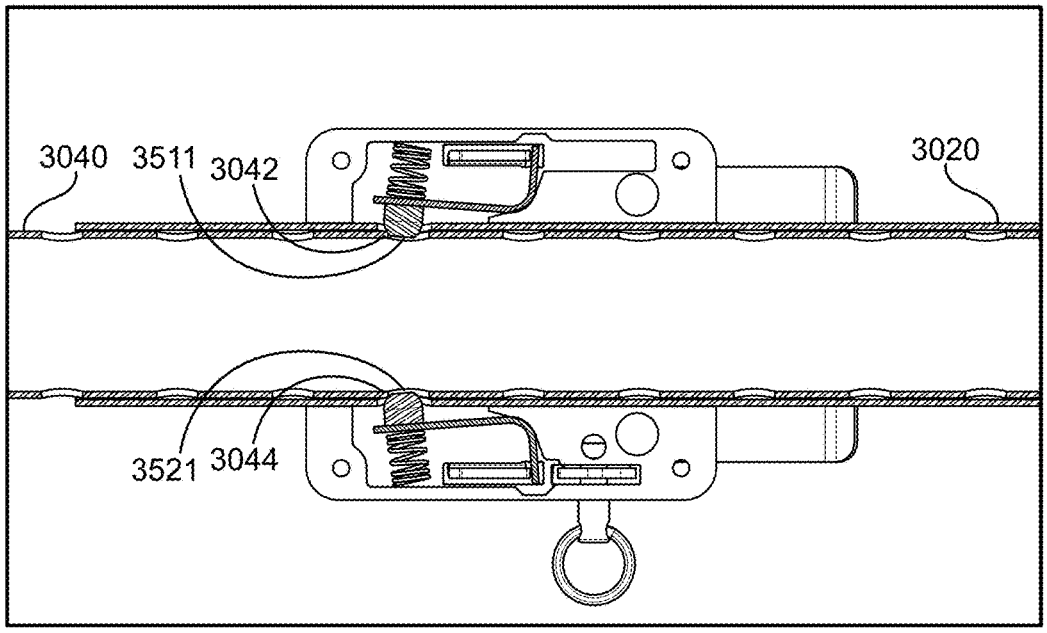
SECTION F-F
Figure 17

AUTOMATIC ADJUSTMENT TUBE FOR CARPET STRETCHER TOOL

CROSS REFERENCE TO RELATED APPLICATIONS

This application claims the benefit of U.S. Provisional Application No. 62/350,161, filed Jun. 14, 2016, which is incorporated by reference in its entirety.

BACKGROUND

This invention relates generally to flooring tools, and in particular to adjusting a length of a carpet stretcher tool during use to install carpet.

In residential construction, the installation of wall-to-wall carpeting first requires nailing carpet retaining wood strips to a subfloor, called tack strip. A tack strip is manufactured with metal pins that extend from the top surface of the wood strip to grip the back of the carpet and hold it in place. Tack strips are nailed down in close proximity to all the walls in the room. The carpet is first hooked at one wall, stretched across the length of the room, and then hooked on the tack strip at the opposite wall. The resulting tension in the stretched carpet keeps it hooked on the tack strip pins and thus flat on the floor. This prevents bumps and creases from forming in the carpet after it is installed, which could create a tripping hazard.

To stretch the carpet across a room, a carpet stretcher tool is used. FIG. 1 shows an assembled prior art carpet stretcher 10 including a power head 20, automatic adjusting tube 30, extension tube 40, and tail block 50. The tubes of the carpet stretcher 10 assemble in a telescoping manner across the length of the room. The power head 20 is placed within about 4 inches of a wall 60 at a slight angle. Power head 20 includes a receiving tube 21, a leverage handle 22, and a pin plate 23. Pin plate 23 grips the carpet. The inside tube 31 of automatic adjusting tube 30 is inserted into the receiving tube 21 of the power head 20. The inside tube 41 of the extension tube 40 is inserted in the outside tube 32 of the automatic adjusting tube 30. A tail block 50 is inserted into the outside tube 42 of extension tube 40. The tail block 50 is braced against wall 70. When leverage handle 22 of power head is lowered (e.g., pushed down by hand), the carpet 80 will be stretched across room 100 in the direction of arrow 90.

FIG. 2 shows an exploded view of a prior art extension tube 40, which includes inside tube 41, outside tube 42, and spring clips 43. Spring clips 43 are inserted into both ends of inside tube 41. Spring clip buttons 44 extend through inside tube holes 45. When inside tube 41 is inserted into outside tube 42, spring clip buttons 44 insert within adjustment holes 46 in the outside tube 42, locking inside tube 41 and outside tube 42 at the particular extension.

To unlock and adjust extension tube 40, spring clip buttons 44 may be depressed using finger pressure. In this way, spring clip buttons 44 can be removed from adjustment holes 46 in outside tube 42, unlocking outside tube 42 from inside tube 41. Inside tube 41 and outside tube 42 can then be extended or retracted until spring clip buttons 44 align with another pair of adjustment holes 46 in outside tube 42. At such point, spring clip buttons 44 insert within a pair of adjustment holes 46, and inside tube 41 and outside tube 42 will again be locked at that extension position. Extension tube 40 can be further adjusted in length, but only by increments of the distance between adjustment holes 46 in outside tube 42, which increment can be larger than desired in some cases.

Furthermore, as inside tube 41 and outside tube 42 are extended and retracted, spring clip buttons 44 will tend to insert in adjustment holes 46 in outside tube 42, and spring clip buttons 44 must be depressed if further adjustment is needed. For this reason, extension tube 40 does not provide a mechanism for automatic adjustment for either extension or retraction. Because this is inconvenient, extension tube 40 is normally used at one set extension so long as it is used in a particular room.

As shown in FIG. 1, for ease of adjustment, an automatic adjusting tube 30 is used to adjust the overall length of carpet stretcher 10 in smaller increments. One such automatic adjusting tube is described in U.S. Pat. No. 4,577,837 to Berg, which describes a carpet stretcher with a tubular extension assembly including an inner tubular member that has a plurality of openings. An outer tubular member telescopes with the inner tubular member and also has openings. A housing is assembled onto the outer tubular member and holds a pair of levers that pivot on pins. The levers include lever actuating plungers on one end and locking plungers on their opposite ends. Berg's outer tubular member can be extended or retracted relative to the inner tubular member by depressing the lever activating plungers, typically using a thumb and forefinger. This removes the locking plungers from the openings of the inner tubular member. In addition, the outer tubular member can be extended automatically without depressing lever activating plungers by pushing back on the housing or the outer tubular member. This is due to the internal shaping of the housing with triangular blocks along with tension springs, which retain levers at an "oblique angle" relative to the axes of the tubes. This angle allows the outer tubular member to extend automatically in the direction of the tail block end of the carpet stretcher. When the outer tubular member is retracted (i.e., pulled back towards the power head end of the carpet stretcher), the locking plungers insert within openings of the inner tubular member, which locks the tubes. A similar motion of the outside tube also occurs when the leverage handle of the carpet stretcher is lowered.

In use, the device of Berg is not ergonomic in certain respects. In the carpet stretching motion, a user normally kneels to the left of the carpet stretcher and lowers the leverage handle with the right hand. From this position, to adjust Berg's tubular extension assembly, the user must turn fully around to their right and use fingers to depress the activating plungers. The twisting motion can cause back strain, and repeatedly depressing the small lever activating plungers is tiring on the fingers, particularly with all the other button activation that is necessary to assemble, adjust, and then disassemble the carpet stretcher as it is moved from room to room on a jobsite.

Furthermore, some motions in using the carpet stretcher are repetitive and could be more efficient if it were possible to extend and retract the tool on the fly. After each stretching motion, the carpet stretcher must be moved to stretch another section of the carpet. To do this, the user lifts the pin plate out of the carpet, typically by lifting at the leverage handle, then kicks the stretcher to the right utilizing the right leg. After moving the carpet stretcher, a new section of the carpet is stretched.

As shown in FIGS. 3 and 4, extension and retraction of the carpet stretcher is frequently required in the direction of either the power head 20 end or the tail block 50 end because rooms frequently include that walls that jog in and out. In FIG. 3, room 110 includes a wall 111 that jogs outwardly at wall surface 112. In the process of moving the carpet stretcher 10 to wall surface 112 (to the user's right), it would be desirable to simply to lift the pin plate 23 out of the carpet by lifting at leverage handle 22, and then pulling forward on the leverage handle 22 to automatically extend the carpet stretcher 10. As shown in FIG. 4, room 120 includes a wall 121 that jogs outwardly at wall surface 122. In the process of moving the tail block 50 of carpet stretcher 10 to wall surface 122 (also to the user's right), it would be desirable simply to pull a handle connected to the automatic adjusting tube to automatically extend the tubes of the carpet stretcher until tail block 50 contacted wall surface 122. Unfortunately, the tubular extension assembly of Berg has no suitable handle.

Conversely, if it were necessary to reduce the length of the carpet stretcher 10 from the power head 20 end, it would be desirable to simply lift at leverage handle 22 to lift pin plate 23 out of the carpet and then pull back on leverage handle 22 to shorten it. If it were necessary to reduce the length of the stretcher from the tail block 50 end, it would be desirable simply to pull back on a handle to retract the tubes until tail block 50 could be braced against an opposite wall at a shorter distance.

What is needed therefore is an automatic adjustment mechanism for a tube of a carpet stretcher that provides automatic extension or retraction in the direction of either the power head or tail block ends, rather than just automatic extension towards the tail block end as prior art devices like Berg's. The process of extension and retraction is desirably activated at convenient gripping surfaces on the carpet stretcher, such as at the leverage handle and some added handle attached to the automatic adjusting tube.

SUMMARY

In various embodiments of the invention, an automatic adjusting tube for a carpet stretcher comprises an inside tube, an outside tube, a housing mounted on the outside tube, and at least one lever connected to the housing. The lever is usable to control the motion of a spring-loaded rotating arm with a locking button positioned within the housing to insert and remove the locking button from holes in the inside tube. In one embodiment, a hand lever hinges on a fulcrum on the housing to control a pair of spring-loaded rotating arms with locking buttons. The hand lever begins from a retracted (or lowered) position. At this position, the hand lever releases the rotating arms, and the rotating arms rotate, being urged by a pair of springs. If the holes in the outside tube and the inside tube are aligned, the rotation of the rotating arms cause the locking buttons to extend through holes in the outside tube and insert within the holes in the inside tube.

When the lever is raised into an extended (or raised) position, this rotates the rotating arms to remove the locking buttons from the holes in the inside tube. With the hand lever extended, the automatic adjustment tube can be automatically extended or retracted by pushing or pulling on the hand lever so long as it is raised. When the hand lever is again retracted from the extended position, if the holes in the outside tube and the inside tube are aligned, the rotating arms will again rotate to extend through holes in the outside tube and insert within the holes in the inside tube. In one embodiment, with the hand lever in a retracted position, the rotating arms and locking buttons are at an oblique angle in relation to the long axes of the outside tube and inside tube, so that if the outside tube is pushed back to extend it the outside tube extends automatically.

In another embodiment, a floor lever hinges on a fulcrum on the housing to control a pair of spring loaded rotating arms with locking buttons. The floor lever retracts when the device contacts a floor surface and extends when the device is lifted off a floor surface. When the device is connected to the power head of the carpet stretcher and both are laid on a floor surface, the floor lever retracts, which releases the rotating arms to rotate, being urged by a pair of springs. If the holes in the outside tube and the inside tube are aligned, the rotation of the rotating arms causes the locking buttons to extend through holes in the outside tube and insert within the holes in the inside tube.

If the power head is lifted off a floor surface, the floor lever extends, which rotates the rotating arms to remove the locking buttons from holes in the inside tube. With the floor lever extended, the automatic adjusting tube can be automatically extended or retracted by pushing or pulling on the power head, preferably at the leverage handle. When the power head is lowered to the floor, the floor lever contacts the floor and retracts. If the holes in the outside tube and the inside tube are aligned, the rotating arms rotate to insert the locking buttons within the holes of the inside tube, being urged by a pair of springs. In one embodiment, with the floor lever in a retracted position, the rotating arms and locking buttons are at an oblique angle in relation to the long axes of the outside tube and inside tube, so that if the outside tube is pushed back to extend it, the outside tube will extend automatically.

BRIEF DESCRIPTION OF THE DRAWINGS

FIG. 10 is an assembled view of an automatic adjustment tube for a carpet stretcher, with a floor lever in a retracted position, in accordance with an embodiment of the invention.

FIG. 11 is a cross sectional view of the automatic adjustment tube of FIG. 10 with the floor lever in the retracted position, along line C-C.

FIG. 12 is an assembled view of the automatic adjustment tube of FIG. 10, with the floor lever in an extended position, in accordance with an embodiment of the invention.

FIG. 13 is a cross sectional view of the automatic adjustment tube of FIG. 12 with the floor lever in the extended position, along line D-D.

FIG. 16 is an assembled view of an automatic adjustment tube for a carpet stretcher, with the floor lever in an extended position, in accordance with an embodiment of the invention.

FIG. 17 is a cross sectional view on an automatic adjustment tube FIG. 16 with the floor lever in an extended position, along line F-F.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 5:
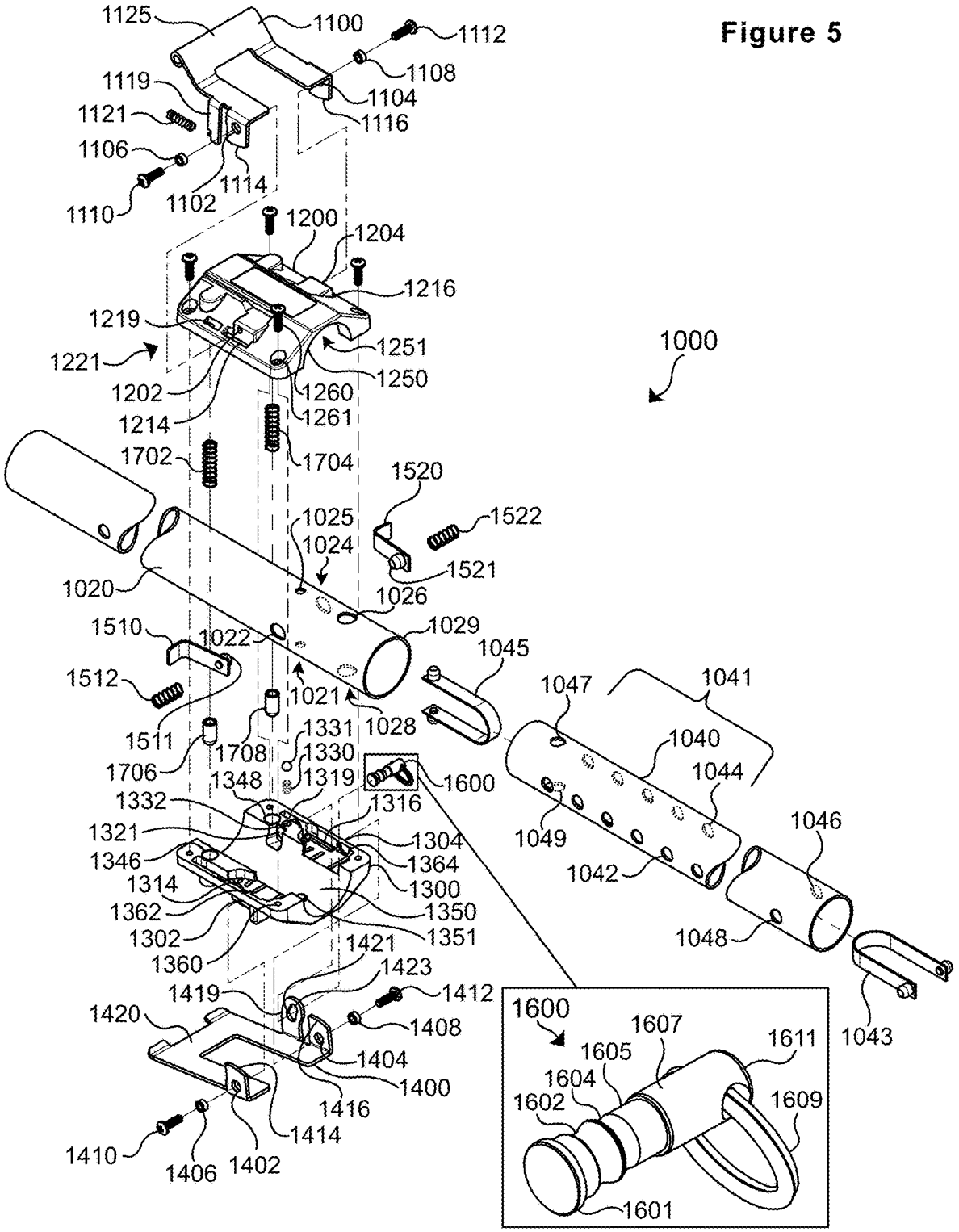
FIG. 5 is an exploded view of an automatic adjustment tube for a carpet stretcher, in accordance with an embodiment of the invention.

As shown in FIG. 5, automatic adjusting tube 1000 includes outside tube 1020, inside tube 1040, hand lever 1100, housing top 1200, rotating arm 1510 with locking button 1511, rotating arm 1520 with locking button 1521, rotating arm springs 1512, 1522, housing bottom 1300, floor lever 1400, floor lever springs 1702, 1704 that activate floor lever 1400, and lock pin 1600 to lock floor lever 1400 in a retracted position.

Hand lever 1100 pivots on housing top 1200 at its hand lever holes 1102, 1104. Bushings 1106, 1108 are inserted into hand lever holes 1102, 1104, and fasteners 1110, 1112 are passed through bushings 1106, 1108 and fastened into housing top lever holes 1202, 1204. Hand lever arms 1114, 1116 are inserted into hand lever arm slots 1214, 1216 in housing top 1200. Hand lever spring arm 1119 is inserted into spring arm slot 1219 of housing top 1200. Hand lever retracting spring 1121 is inserted into a hand lever spring holding cavity 1221 in housing top 1200. Hand lever retracting spring 1121 contacts the back of hand lever spring arm 1119 to retract it against housing top 1200 when released by the user.

Floor lever 1400 pivots on housing bottom 1300 at its floor lever holes 1402, 1404. Bushings 1406, 1408 are inserted into floor lever holes 1402, 1404. Fasteners 1410, 1412 are passed through bushings 1406, 1408 and fastened into holes 1302, 1304 of housing bottom 1300. Floor lever arms 1414, 1416 insert into floor lever arm slots 1314, 1316 in housing bottom 1300. A locking arm 1419 inserts into a locking arm slot 1319 in housing bottom half 1300. Locking arm 1419 includes a locking arm hole 1421 formed in conjunction with a locking arm radial slot 1423.

Lock pin 1600 along with ball spring 1330 and ball 1331 create a locking mechanism for floor lever 1400 that operates in two positions. Ball spring 1330 and ball 1331 insert within a ball blind hole 1332 in housing bottom 1300. Lock pin 1600 inserts into lock pin hole 1321 of bottom half 1300, with end 1611 entering first (pull ring 1609 not yet installed). Lock pin 1600 has an inner large diameter 1601, inner groove 1602, outer groove 1604, middle small diameter 1605, and outer medium diameter 1607. Lock pin 1600 passes over ball spring 1330 and ball 1331, holding these inside ball blind hole 1332. Lock pin 1600 extends through locking arm hole 1421 in locking arm 1419 when floor lever 1400 is in a retracted position. Inner large diameter 1601 of lock pin 1600 is larger in diameter than lock pin hole 1321 in housing bottom 1300, thus preventing lock pin 1600 from pulling out. Once lock pin 1600 is assembled in this manner, pull ring 1609 is installed on lock pin 1600.

When lock pin 1600 is in an outer position, ball 1331 is pressured upward by ball spring 1330 and enters an inner groove 1602 of lock pin 1600. With lock pin 1600 in this outer position and floor lever 1400 retracted, middle small diameter 1605 of lock pin 1600 aligns with locking arm hole 1421 of locking arm 1419. Middle small diameter 1605 of lock pin 1600 is smaller in dimension than the width of locking arm radial slot 1423. Thus, as floor lever 1400 pivots downward to extend, middle small diameter 1605 of lock pin 1600 will pass within locking arm radial slot 1423, permitting floor lever 1400 to extend.

With floor lever 1400 is retracted, and lock pin 1600 is in an inner position, ball 1331 enters outer groove 1604, and outer medium diameter 1607 of lock pin 1600 aligns with locking arm hole 1421. Outer medium diameter 1607 of lock pin 1600 is larger in dimension than the width of locking arm radial slot 1423. This prevents floor lever 1400 from extending, if desired, for reasons to be explained below.

Floor lever 1400 is urged to extend by floor lever springs 1702, 1704. Floor lever springs 1702, 1704 are inserted into plungers 1706, 1708 which pass through plunger holes 1346, 1348. Plungers 1706, 1708 contact a top surface 1420 of floor lever 1400, producing pressure on floor lever 1400 to extend it.

Outer tube 1020 is positioned in the midsection 1350 of housing bottom 1300 with a boss 1351 extending into a bottom positioning hole 1021 in outer tube 1020. Rotating arms 1510, 1520 are inserted into cavities 1362, 1364 of housing bottom 1300. Rotating arm springs 1512, 1522 are inserted behind rotating arms 1510, 1520. When holes 1022, 1024 in outside tube 1020 are in alignment with adjustment holes 1042, 1044 of inside tube 1040, rotating arm springs 1512, 1522 urge locking buttons 1511, 1521 to extend through holes 1022, 1024 in outer tube 1020 and insert into adjustment holes 1042, 1044 in inner tube 1040.

Housing top 1200 is positioned on top of outer tube 1020 at midsection 1250 with a boss 1251 inserting into a top positioning hole 1025 in outer tube 1020. Fasteners 1260 pass through holes 1261 in housing top 1200 into holes 1360 in housing bottom 1300 to fasten housing top 1200 to housing bottom 1300.

Figure 6:
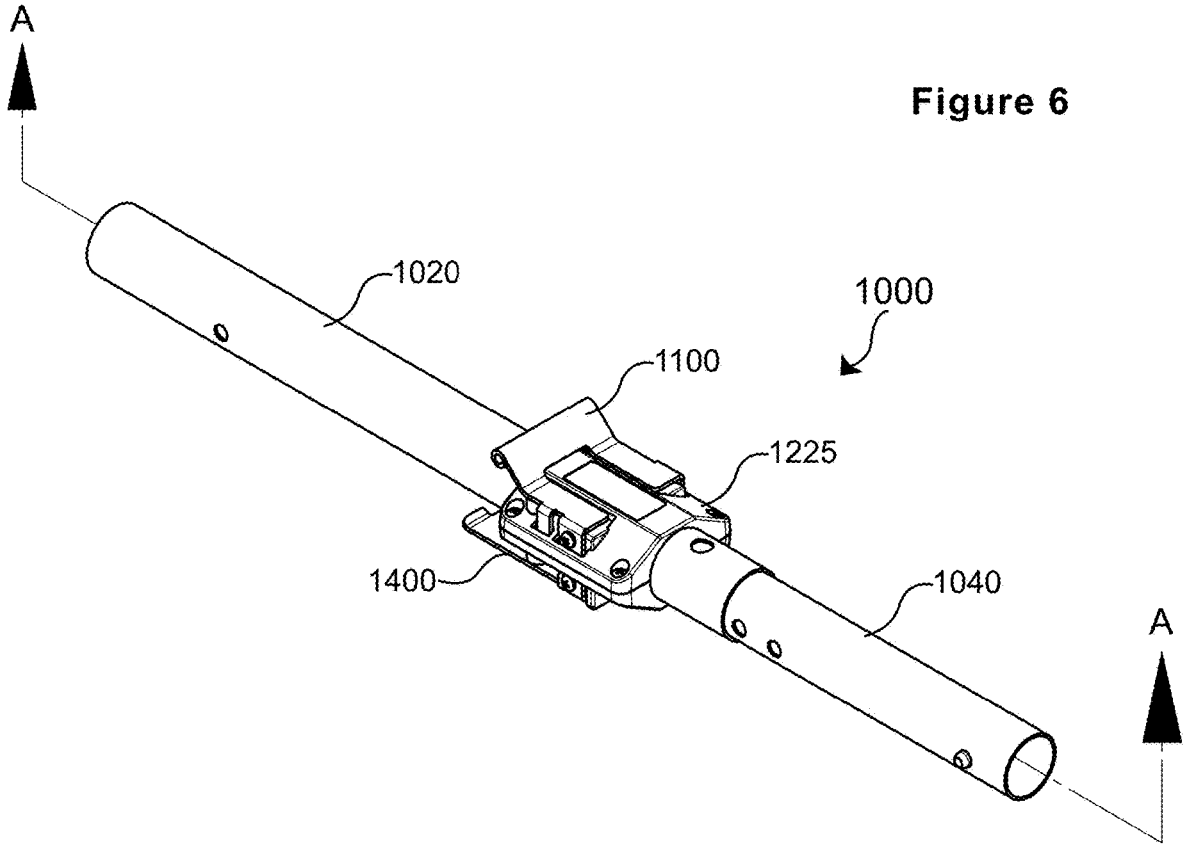
FIG. 6 is an assembled view of an automatic adjustment tube for a carpet stretcher, with a hand lever in a retracted position, in accordance with an embodiment of the invention.
Figure 7:
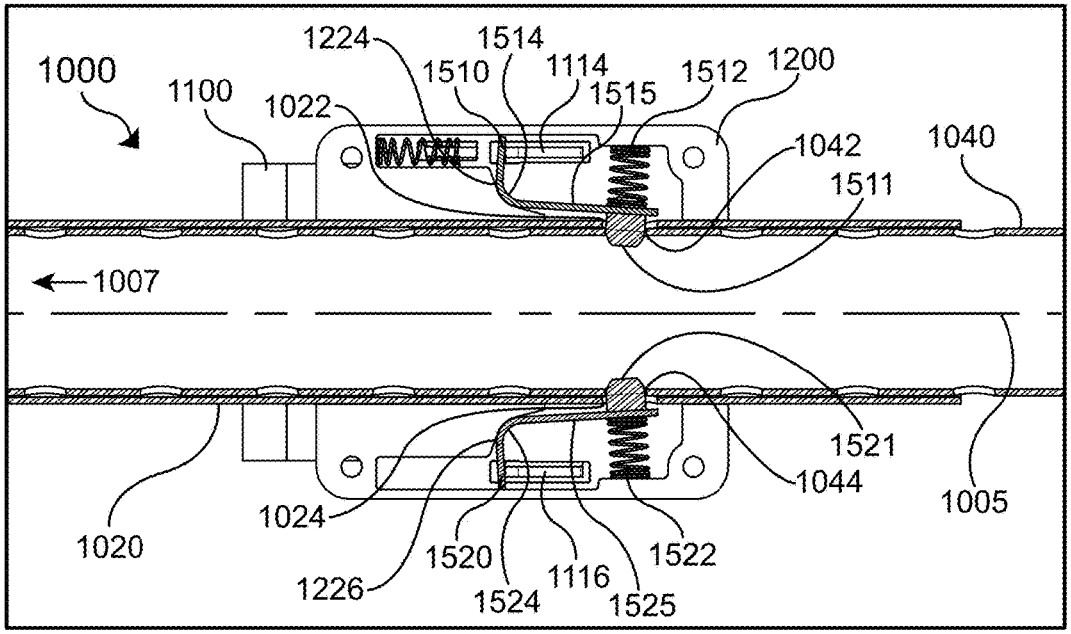
FIG. 7 is a cross sectional view of the automatic adjustment tube of FIG. 6 with the hand lever in the retracted position, along line A-A.

FIG. 6 shows the assembled adjustment tube 1000, with hand lever 1100 retracted, floor lever 1400 retracted, and section A-A taken in a plane that illustrates the position of hand lever arms 1114, 1116 (FIG. 7). In FIG. 7, section A-A shows that with hand lever 1100 retracted, hand lever arms 1114, 1116 also retract, releasing rotating arms 1510, 1520 to rotate, being urged by rotating arm springs 1512, 1522. As rotating arms 1510, 1520 rotate, locking buttons 1511, 1521 extend through holes 1022, 1024 in outside tube 1020 and insert within adjustment holes 1042, 1044 in inside tube 1040. Holes 1022, 1024 in outside tube 1020 and adjustment holes 1042, 1044 in inside tube 1040 are aligned.

Figure 8:
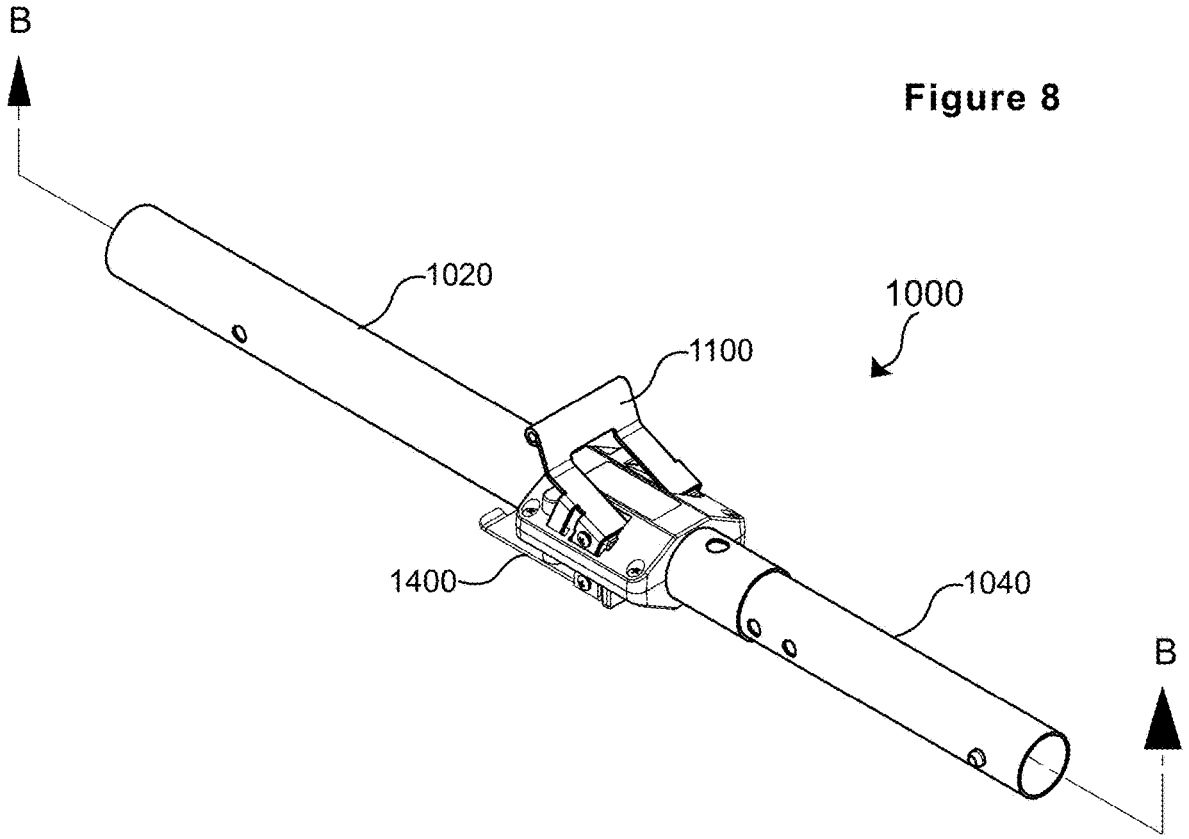
FIG. 8 is an assembled view of automatic adjustment tube for a carpet stretcher, with the hand lever in an extended position, in accordance with an embodiment of the invention.
Figure 9:
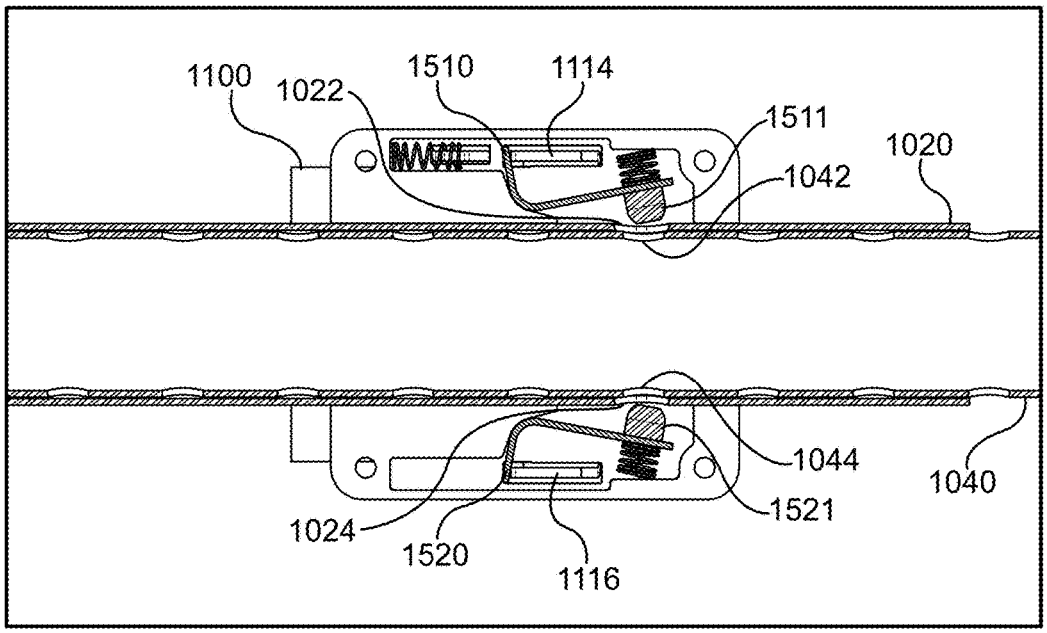
FIG. 9 is a cross sectional view of the automatic adjustment tube of FIG. 8 with the hand lever in the extended position, along line B-B.

FIG. 8 shows the assembled adjustment extension tube 1000, with hand lever 1100 extended, floor lever 1400 retracted, and section B-B taken in a plane that illustrates the position of hand lever arms 1114, 1116 (FIG. 9) and rotating arms 1510, 1520 (FIG. 9). In FIG. 9, section B-B shows that with hand lever 1100 extended, hand lever arms 1114, 1116 also extend, which rotates rotating arms 1510, 1520 to a position where locking buttons 1511, 1521 are removed from adjustment holes 1042, 1044 in inside tube 1040. Holes 1022, 1024 in outside tube 1020 and adjustment holes 1042, 1044 in inside tube 1040 are aligned.

FIG. 10 shows the assembled automatic adjustment tube 1000, with hand lever 1100 retracted, floor lever 1400 retracted, and section C-C taken in a plane that illustrates the position of floor lever arms 1414, 1416 (FIG. 11) and rotating arms 1510, 1520 (FIG. 11). In FIG. 11, section C-C shows that with floor lever 1400 retracted, floor lever arms 1414, 1416 also retract, releasing rotating arms 1510, 1520 to rotate, being urged by rotating arm springs 1512, 1522. As rotating arms 1510, 1520 rotate, locking buttons 1511, 1521 extend through holes 1022, 1024 in outside tube 1020 and into adjustment holes 1042, 1044 in inside tube 1040. Holes 1022, 1024 in outside tube 1020 and adjustment holes 1042, 1044 in inside tube 1040 are aligned.

FIG. 12 shows the assembled automatic adjustment tube 1000, with hand lever 1100 retracted, floor lever 1400 extended, and section D-D taken in a plane that illustrates the position of floor lever arms 1414, 1416 (FIG. 13) and rotating arms 1510, 1520 (FIG. 13). In FIG. 13, section D-D shows that with floor lever 1400 extended, floor lever arms 1414, 1416 also extend, which rotates rotating arms 1510, 1520 to a position where locking buttons 1511, 1521 are removed from adjustment holes 1042, 1044 in inside tube 1040. Holes 1022, 1024 in outside tube 1020 and adjustment holes 1042, 1044 in inside tube 1040 are aligned.

FIG. 7 shows that rotating arm 1510 includes bend 1514, and rotating arm 1520 includes bend 1524. Housing top 1200 includes contours 1224, 1226 and housing bottom 1300 (FIG. 11) includes contours 1324, 1326 (FIG. 11). The contours 1224, 1226 and 1324, 1326 (FIG. 11) correspond in shape and together form fulcrums for rotating arm 1510, 1520 at bends 1514, 1524. Contours 1224, 1226 and 1324, 1326 (FIG. 11) additionally permit button legs 1515, 1525 of rotating arms 1510, 1520 to rotate to an oblique angle in relation to a long axis 1005 of automatic adjustment tube 1000, being urged by rotating arm springs 1512, 1522. This oblique angle combines with the oblong shape of holes 1022, 1024 (FIG. 5) in outside tube 1020 (longer horizontally than circular adjustment holes 1042, 1042 in inside tube 1040—FIG. 5) and the rounded ends of locking buttons 1511, 1521 to allow automatic adjustment tube 1000 to always extend automatically. The difference in shape between holes 1022, 1024 (FIG. 5) in outside tube 1020 and adjustment holes 1042, 1044 in inside tube 1040 wedges locking buttons 1511, 1521 out of these holes as they move past each other. The rounded ends of locking buttons 1511, 1521 also force locking buttons 1511, 1521 out of adjustment holes 1042, 1044 in inside tube 1040. As shown in FIG. 6, if a user pushes back on housing 1225 or pushes on outside tube 1020, automatic adjustment tube 1000 will extend automatically in the direction of arrow 1007 (FIG. 7) even when hand lever 1100 (FIG. 6) and floor lever 1400 (FIG. 6) are not extended.

Figure 1:
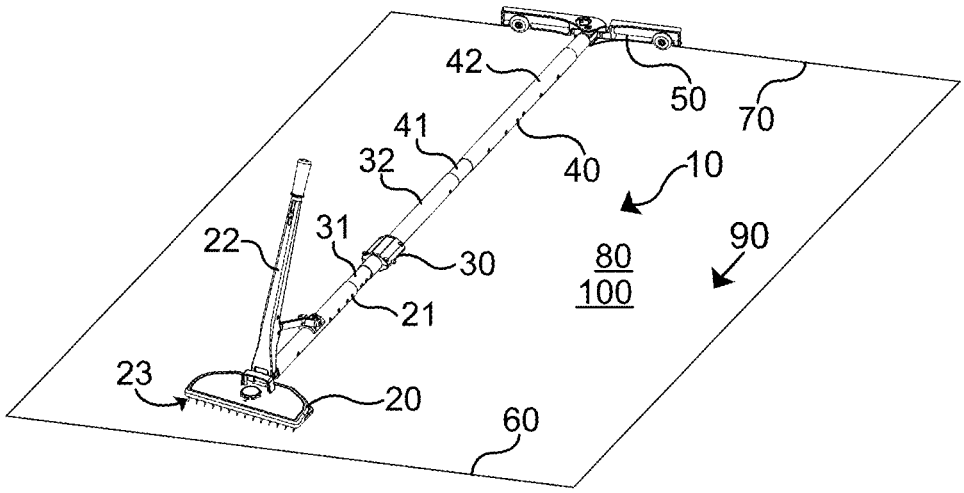
Figure 1 Prior Art
FIG. 1 shows an assembled prior art carpet stretcher in a room.
Figure 2:
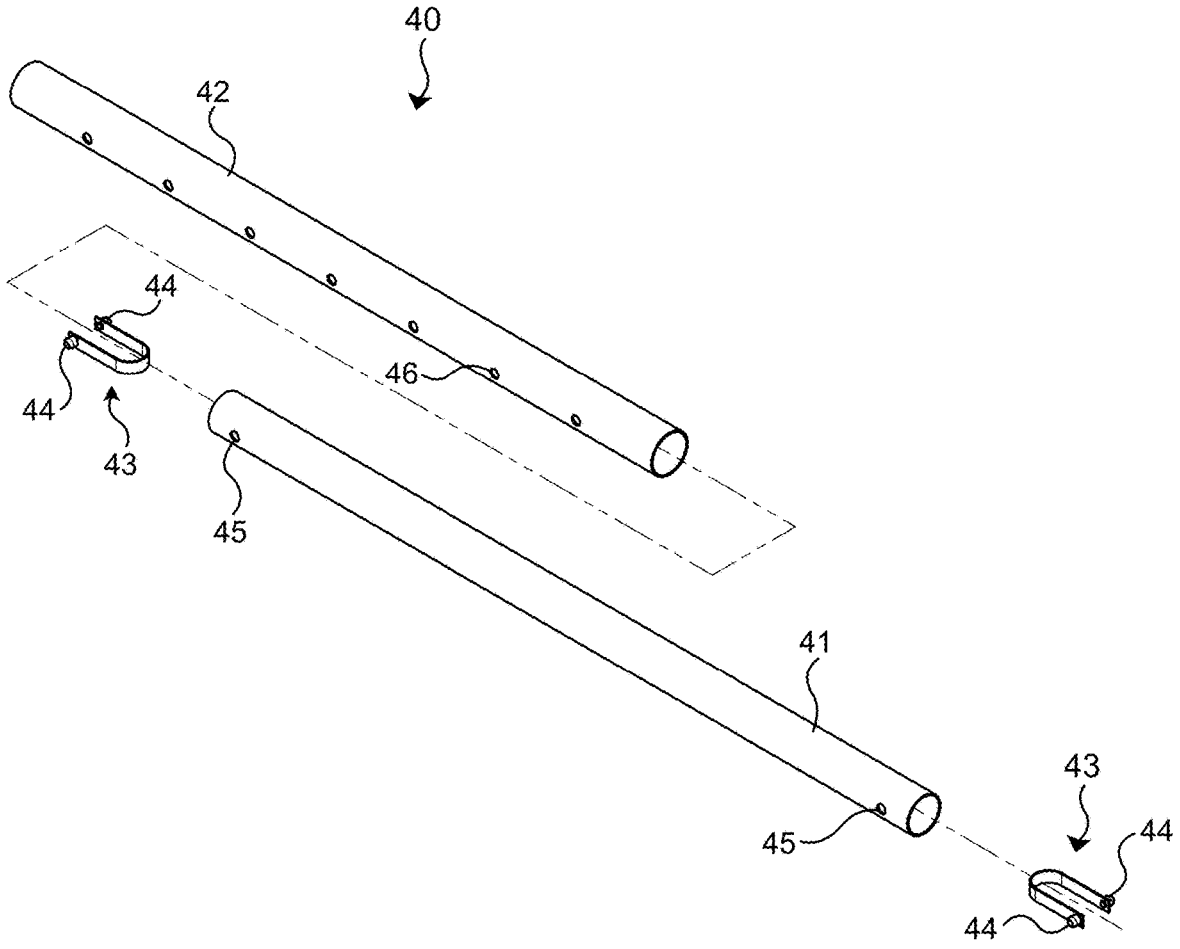
Figure 2 Prior Art
FIG. 2 shows an exploded view of an extension tube of a prior art carpet stretcher.
Figure 3:
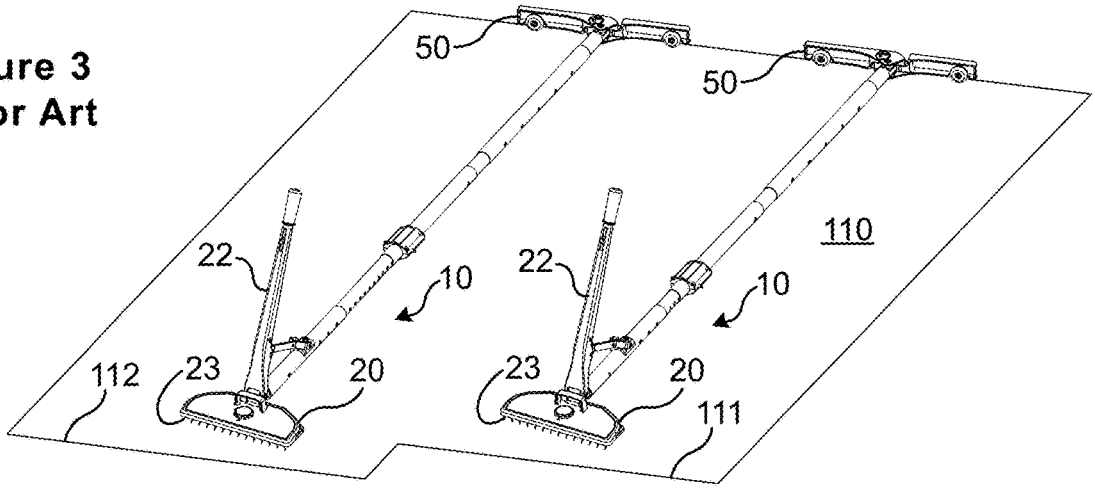
Figure 3 Prior Art
FIGS. 3 and 4 show the extension and retraction of prior art carpet stretchers for example rooms including walls that jog in and out.
Figure 4:
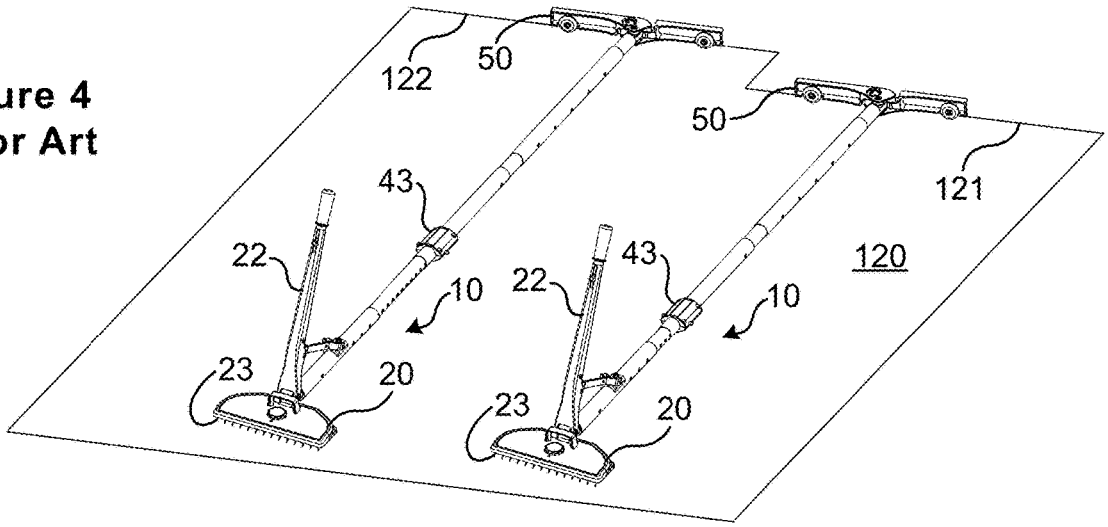
Figure 4 Prior Art

As shown in FIG. 5, automatic adjustment tube 1000 includes a spring clip 1043 comparable to prior art spring clip 43 (FIG. 2). Spring clip 1043 is inserted at a distal end of inside tube 1040 as shown. The buttons of spring clip 1043 insert within end holes 1046, 1048 which are horizontal in orientation and in the same plane as adjustment holes 1042, 1044 of inside tube 1040. Spring clip 1043 is used to lock automatic adjustment tube 1000 with a receiving tube of a carpet stretcher (e.g., the receiving tube 21 shown in FIG. 1).

As shown in FIG. 5, automatic adjustment tube 1000 additionally includes safety spring clip 1045. Inside tube 1040 includes inside tube safety lock holes 1047, 1049, and outside tube 1020 includes outside tube safety lock holes 1026, 1028. Inside tube safety lock holes 1047, 1049 and outside tube safety lock holes 1026, 1028 are both vertically oriented. Safety spring clip 1045 is inserted at the proximal end of inside tube 1040 as shown. The buttons of safety spring clip 1045 are inserted within inside tube safety lock holes 1047, 1049.

The normal range of adjustment for automatic adjustment tube 1000 is the hole pattern 1041 of adjustment holes 1042, 1044 in inside tube 1040. If the locking buttons 1511, 1521 move beyond hole pattern 1041 (forming a plurality of holes) in the direction of inside tube safety lock holes 1047, 1049, the buttons of safety spring clip 1045 will insert within safety holes 1026, 1028 of outside tube 1020, preventing inside tube 1040 from coming apart from outside tube 1020. Hole pattern 1041 of adjustment holes 1042, 1044 are horizontally oriented, whereas inside tube safety lock holes 1047, 1049 and outside tube safety lock holes 1026, 1028 are vertically oriented in a different plane.

As shown in FIG. 5, automatic adjustment tube 1000 includes lock pin 1600. Lock pin 1600 allows the user to prevent floor lever 1400 from automatically extending and unlocking if automatic adjustment tube 1000 is lifted off the floor. This may desirable for example when carpet stretcher is disassembled and automatic adjustment tube 1000 is lifted off the floor to be carried to another room.

Automatic adjustment tube 1000 can be automatically extended or retracted in the direction of tail block end 50 (FIG. 1) end by lifting hand lever 1100 and pushing or pulling on it. Hand lever 1100 forms a large ergonomic handle surface 1125 to grasp and push or pull. With this large handle surface 1125, the user can more easily adjust automatic adjustment tube 1000 simply by reaching back and grasping at large handle surface 1125. Floor lever 1400 permits the power head of the stretcher to be extended or retracted efficiently in conjunction with the normal operating motion of lifting the power head of the carpet stretcher as required each time a new section of carpet is stretched. Floor lever 1400 can be locked in a retracted position if necessary for example for convenient carrying of the automatic adjustment tube 1000 from room to room on the jobsite.

Figure 14:
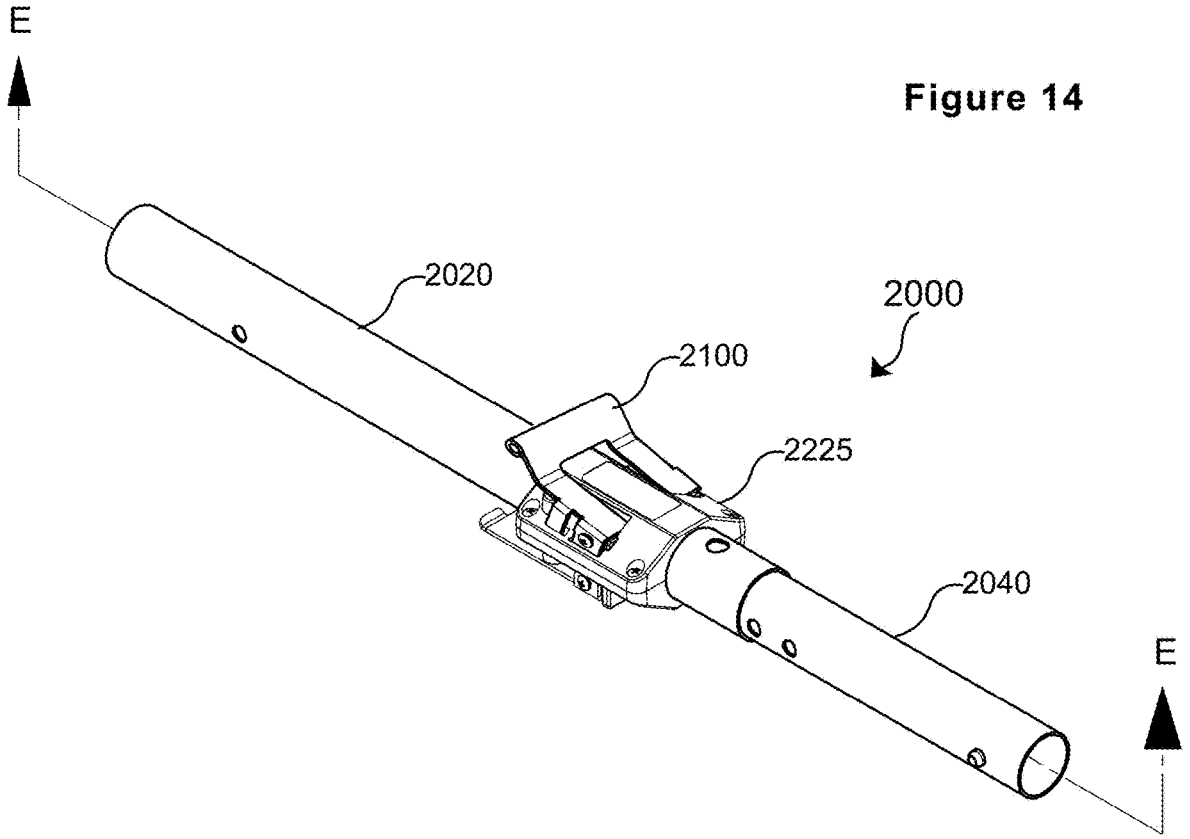
FIG. 14 is an assembled view of an automatic adjustment tube for a carpet stretcher, with the hand lever in an extended position, in accordance with an embodiment of the invention.
Figure 15:
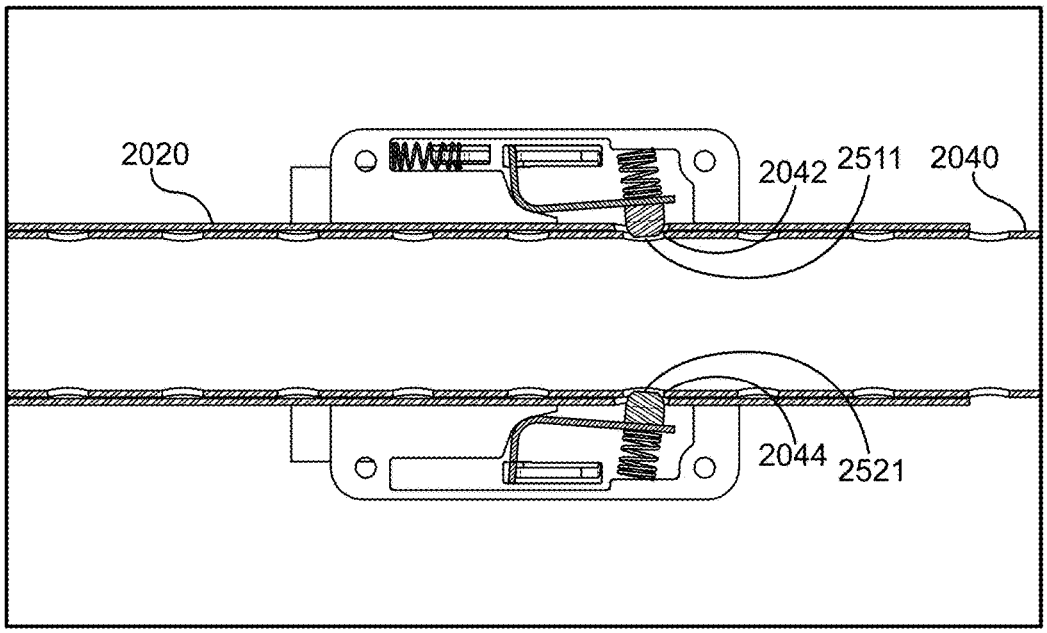
FIG. 15 is a cross sectional view of an automatic adjustment tube of FIG. 14 with the hand lever in an extended position, along line E-E.

In one embodiment, the hand lever of the automatic adjustment tube extends a reduced distance from the housing, moving the the rounded ends of the locking buttons in a direction outward of the adjustment holes in the inside tube, but not completely removing the locking buttons from the adjustment holes in the inside tube. FIG. 14 shows automatic extension tube 2000 with hand lever 2100 extended a reduced distance from housing 2225 and a section E-E taken in a plane that illustrates locking buttons 2511, 2521 (FIG. 15) having moved in a direction outward of adjustment holes 2042, 2044 (FIG. 15) in inside tube 2040 (FIG. 15), but not completely removed from adjustment holes 2042, 2044 (FIG. 15). In FIG. 15, Section E-E shows that due to the rounded ends on locking buttons 2511, 2521, locking buttons 2511, 2521 need not be completely removed from adjustment holes 2042, 2044 for outside tube 2020 and inside tube 2040 to extend and retract. This is because the rounded ends on locking buttons 2511, 2521 cause locking buttons 2511, 2521 to move out of 2042, 2044 when outside tube 2020 and inside tube 2040 are extended or retracted.

In another embodiment, the floor lever of the automatic adjustment tube extends a reduced distance from the housing, moving the rounded ends of the locking buttons in a direction outward of the adjustment holes in the inside tube, but not completely removing the locking buttons from the adjustment holes in the inside tube. FIG. 16 shows automatic tension tube 3000 with floor lever 3400 extended a reduced distance from housing 3225 and a section F-F taken in a plane that illustrates locking buttons 3511, 3521 (FIG. 17) having moved in a direction outward of adjustment holes 3042, 3044 (FIG. 17) in inside tube 3040 (FIG. 17), but not completely removed from adjustment holes 3042, 3044 (FIG. 17). In FIG. 17, Section F-F shows that due to the rounded ends on locking buttons 3511, 3521, locking buttons 3511, 3521 need not be completely removed from adjustment holes 3042, 3044 for outside tube 3020 and inside tube 3040 to extend and retract. This is because the rounded ends on locking buttons 3511, 3521 cause locking buttons 3511, 3521 to move out of 3042, 3044 when outside tube 3020 and inside tube 3040 are extended or retracted.

The embodiment of FIGS. 8 and 9 and 12 and 13 also show locking buttons 1511, 1521 moving in a direction outward of adjustment holes 1042, 1044. In FIG. 8, hand lever 1100 extends to rotate rotating arms 1510, 1520 (FIG. 9) to move locking buttons 1511, 1521 (FIG. 9) in the same direction outward of adjustment holes 1042, 1044 (FIG. 9). In FIG. 12, floor lever 1400 extends to rotate rotating arms 1510, 1520 (FIG. 13) to move locking buttons 1511, 1521 in the same direction outward of adjustment holes 1042, 1044.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure. Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

The present illustrated embodiments can be characterized in a number of ways. First, the device could be sold as part of a complete carpet stretcher, as shown in FIG. 1, having an improved automatic extension tube illustrated in any of FIG. 5-15 or set out in this detailed description. The device is connectable to prior art carpet stretcher tools as shown in FIG. 1 and could be sold separately as an accessory for prior art carpet stretcher tools. In addition, the device is connectable to prior art extension tubes as shown in FIG. 2 and could be sold as a part of set of tubes. The device could be sold with or without a carrying case. Alternatively, the device could be sold disassembled. The elements would remain the same, but would require assembly by the user prior to use.

What is claimed is:

1. An automatic adjusting tube for a carpet stretcher, comprising:

an outside tube with a hole;

an inside tube that telescopes with the outside tube and has a plurality of holes with least one hole that aligns with the hole of the outside tube;

a housing on the outside tube;

a rotating arm that pivots on a first pivot with a locking button within the housing, wherein the locking button passes through the hole of the outside tube and into a one of the plurality of holes of the inside tube that is aligned with the hole of the outside tube; and a lever that pivots on a second pivot different than the first pivot to rotate the rotating arm to move the locking button in a direction outward of the one of the plurality of holes of the inside tube that is aligned with the hole of the outside tube.

2. The automatic adjusting tube of claim 1, wherein extending the lever away from the housing rotates the rotating arm.

3. The automatic adjusting tube of claim 1, wherein when the automatic adjusting tube is attached to a power head of the carpet stretcher on a floor surface, the lever is connected to a top portion of the housing that faces away from the floor surface when the carpet stretcher is in use.

4. The automatic adjusting tube of claim 1, further comprising:

a spring that urges the rotating arm to rotate, wherein when the lever is retracted towards the housing, the spring rotates the rotating arm to insert the locking button within the one of the plurality of holes in the inside tube that is aligned with the hole of the outside tube.

5. The automatic adjusting tube of claim 4, wherein the spring urges the rotating arm to rotate to an oblique angle in relation to the long axis of the outside tube.

6. The automatic adjusting tube of claim 1, wherein moving the automatic adjustment tube off a floor surface moves the lever, which causes the lever to rotate the rotating arm.

7. The automatic adjusting tube of claim 6, further including a lock pin to prevent the lever from moving.

8. The automatic adjusting tube of claim 1, further comprising a spring that urges the lever to extend from the housing, wherein moving the automatic adjustment tube off a floor surface extends the lever.

9. The automatic adjusting tube of claim 1, wherein the rotating arm includes a bend forming a surface the lever contacts to rotate the rotating arm.

10. The automatic adjusting tube of claim 9, wherein the housing includes a contour forming a fulcrum on which the bend of the rotating arm rotates.

11. The automatic adjusting tube of claim 1, further including a safety lock hole in the outside tube, a safety lock hole in the inside tube, and a spring clip with a locking button, wherein the safety lock hole of the outside tube and the safety lock hole of the inside tube are formed on a different plane than the hole of the outside tube and the plurality of holes of the inside tube, and wherein the locking button of the spring clip passes through the safety lock hole in the inside tube and the safety lock hole in the outside tube to lock the inside tube with the outside tube after the locking button of the rotating arm passes beyond the plurality of holes in the inside tube.

12. An automatic adjusting tube for a carpet stretcher, comprising:

an outside tube with a hole;

an inside tube that telescopes with the outside tube and has a plurality of holes with at least one hole that aligns with the hole of the outside tube;

a housing on the outside tube;

a rotating arm in the housing, the rotating arm including a locking button that passes through the hole of the outside tube and into a one of the plurality of holes of the inside tube that is aligned with the hole of the outside tube; and a lever attached to the housing, wherein lifting the lever rotates the rotating arm to move the locking button in a direction outward of the one of the plurality of holes in the inside tube that is aligned with the hole of the outside tube.

13. The automatic adjusting tube of claim 12, further comprising:

a spring that urges the rotating arm to rotate, wherein lowering the lever from the lifted position releases the rotating arm to rotate to insert the locking button within the one of the plurality of holes in the inside tube that is aligned with the hole of the outside tube.

14. The automatic adjusting tube of claim 13, wherein the spring urges the rotating arm to rotate to an oblique angle in relation to the long axis of the outside tube.

15. The automatic adjusting tube of claim 12, wherein the rotating arm includes a bend forming a surface the lever contacts to rotate the rotating arm.

16. The automatic adjusting tube of claim 15, wherein the housing includes a contour forming a fulcrum on which the bend of the rotating arm rotates.

17. An automatic adjusting tube for a carpet stretcher, comprising:

an outside tube with a hole;

an inside tube that telescopes with the outside tube and has a plurality of holes with at least one hole that aligns with the hole of the outside tube;

a housing on the outside tube;

a rotating arm in the housing, the rotating arm including a locking button that passes through the hole of the outside tube and into a one of the plurality of holes of the inside tube that is aligned with the hole of the outside tube; and a lever attached to the housing that extends toward a floor surface, wherein when the automatic adjusting tube is placed on a floor surface, moving the automatic adjustment tube off a floor surface extends the lever towards the floor surface and rotates the rotating arm to move the locking button in a direction outward of the one of the plurality of holes of the inside tube that is aligned with the hole of the outside tube.

18. The automatic adjusting tube of claim 17, further including a spring that urges the lever to extend towards the floor surface.

19. The automatic adjusting tube of claim 17, further comprising:

a lock pin to prevent the lever from extending.

20. The automatic adjusting tube of claim 17, further including:

a spring that urges the rotating arm to rotate, wherein retracting the lever from the extended position releases the rotating arm to rotate to insert the locking button within the hole in the inside tube.

21. The automatic adjusting tube of claim 20, wherein the spring urges the rotating arm to rotate to an oblique angle in relation to the long axis of the outside tube.

22. The automatic adjusting tube of claim 17, wherein the rotating arm includes a bend forming a surface the lever contacts to rotate the rotating arm.

23. The automatic adjusting tube of claim 22, wherein the housing includes a contour forming a fulcrum on which the bend of the rotating arm rotates.

24. An automatic adjusting tube for a carpet stretcher, comprising:

an outside tube with a hole;

an inside tube that telescopes with the outside tube and has a plurality of holes with at least one hole that aligns with the hole of the outside tube;

a rotating arm that pivots on a first pivot with a locking button that passes through the hole of the outside tube and into a one of the plurality of holes of the inside tube that is aligned with the hole of the outside tube; and a lever that pivots on a second pivot different from the first pivot to rotate the rotating arm to move the locking button in a direction outward of the hole of the inside tube that is aligned with the hole of the outside tube.

25. An automatic adjusting tube for a carpet stretcher, comprising:

an outside tube with a hole;

an inside tube that telescopes with the outside tube and has a plurality of holes with at least one hole that aligns with the hole of the outside tube;

a housing on the outside tube;

a rotating arm with a locking button within the housing, wherein the locking button passes through the hole of the outside tube and into a one of the plurality of holes of the inside tube that is aligned with the hole of the outside tube;

a hand lever attached to the housing, wherein lifting the hand lever rotates the rotating arm to move the locking button in a direction outward of the one of the plurality of holes in the inside tube that is aligned with the hole of the outside tube; and a floor lever attached to the housing that extends toward a floor surface, wherein when the automatic adjusting tube is placed on the floor surface, moving the automatic adjustment tube off the floor surface extends the floor lever and rotates the rotating arm to move the locking button in a direction outward of the one of the plurality of holes of the inside tube that is aligned with the hole of the outside tube.

26. The automatic adjusting tube of claim 25, further comprising:

a spring that urges the rotating arm to rotate to insert the locking button within the one of the plurality of holes in the inside tube that is aligned with the hole of the outside tube.

27. The automatic adjusting tube of claim 26, wherein the spring urges the rotating arm to rotate to an oblique angle in relation to the long axis of the outside tube.

28. The automatic adjusting tube of claim 25, wherein the rotating arm includes a bend forming a surface the lever contacts to rotate the rotating arm.

29. The automatic adjusting tube of claim 28, wherein the housing includes a contour forming a fulcrum on which the bend of the rotating arm rotates.

30. The automatic adjusting tube of claim 25, further including a spring that urges the floor lever to extend towards the floor surface.

31. The automatic adjusting tube of claim 25, further comprising:

a lock pin to prevent the floor lever from extending.

32. An automatic adjusting tube for a carpet stretcher, comprising:

an outside tube with a hole;

an inside tube that telescopes with the outside tube and has a plurality of holes with at least one of the plurality of holes that aligns with the hole of the outside tube;

a locking button that passes through the hole of the outside tube and into one of the plurality of holes of the inside tube that is aligned with the hole of the outside tube; and a lever that pivots away from the outside tube to move the locking button in a direction outward of the one of the plurality of holes of the inside tube that is aligned with the hole of the outside tube.

* * * * *